US005690133A

United States Patent [19]

Capwell

[11] Patent Number: 5,690,133

[45] Date of Patent: Nov. 25, 1997

[54] FLOATING SUN SHIELD

[76] Inventor: Bruce Capwell, 5555 Flat River Rd., Greene, R.I. 02827

[21] Appl. No.: 731,962

[22] Filed: Oct. 23, 1996

[51] Int. Cl.[6] ..... A45B 23/00

[52] U.S. Cl. ..... 135/124; 135/96; 135/16; 4/498; 441/38

[58] Field of Search ..... 135/124, 96, 16; 4/496, 498, 499; 441/38

[56] References Cited

U.S. PATENT DOCUMENTS

| | | | |
|---|---|---|---|
| 1,746,833 | 2/1930 | Hermansen | 135/96 X |
| 2,142,851 | 1/1939 | Jolly . | |
| 2,804,633 | 9/1957 | Taylor et al. | 441/38 |
| 2,928,108 | 3/1960 | Cochrane et al. | 441/38 X |
| 2,932,833 | 4/1960 | Wambach | 135/96 X |
| 3,042,053 | 7/1962 | Gabriel . | |
| 3,070,107 | 12/1962 | Beatty . | |
| 3,190,300 | 6/1965 | Wear'n . | |
| 3,386,456 | 6/1968 | Walker . | |
| 3,415,719 | 12/1968 | Telkes | 441/38 X |
| 3,811,454 | 5/1974 | Huddle | 135/124 |
| 3,868,155 | 2/1975 | Cherubini . | |
| 4,184,501 | 1/1980 | Johnson . | |
| 4,248,255 | 2/1981 | Arrowsmith | 135/96 |
| 4,393,888 | 7/1983 | Nivin | 135/96 X |
| 4,766,918 | 8/1988 | Odekirk | 135/96 X |
| 4,821,353 | 4/1989 | Neri . | |
| 5,293,652 | 3/1994 | Furr | 4/498 |
| 5,299,588 | 4/1994 | MacLeod | 135/16 |
| 5,313,666 | 5/1994 | Bax et al. . | |

FOREIGN PATENT DOCUMENTS

| | | | |
|---|---|---|---|
| 0859524 | 1/1961 | United Kingdom | 441/38 |
| 0636776 | 5/1980 | United Kingdom | 441/38 |

*Primary Examiner*—Wynn E. Wood
*Attorney, Agent, or Firm*—Welsh & Katz, Ltd.

[57] ABSTRACT

A floating sun shield apparatus includes a frame having oppositely disposed longitudinal frame members and oppositely disposed transverse frame members. The frame members have a perimeter defining a user area. Also included is a canopy operatively coupled to the frame and disposed over the user area where the canopy is configured to block sunlight from the user area. Two flexible canopy support rods releasably attach to the frame at opposite ends substantially forming an arch where each support rod is configured to attach to either the longitudinal frame members or to the transverse frame members such that the canopy support rods are maintained in a flexed convex orientation relative to the frame. The canopy has opposite longitudinal sides configured to engage the canopy support rods such that the canopy is maintained in a curved orientation above the user area. The frame is configured to be buoyant in water such that the canopy is maintained above the user area.

21 Claims, 2 Drawing Sheets

FLOATING SUN SHIELD

BACKGROUND OF THE INVENTION

The present invention relates generally to sun shields and sun protectors and more specifically to a floating sun shield for use on water.

Sun bathing in various forms is known to enhance facial wrinkling and increase the risk of certain skin cancers. The harmful effects of sun bathing are increased when the sun bather is located on a beach or on water, due to the reflection of the sunrays, which tend to increase the intensity of the radiation received by the individual. Devices which block sunlight by providing shade are generally placed on land in the area where the individual desires to sun bathe.

An example of a known sun shield is disclosed in U.S. Pat. No. 5,313,666, issued on May. 24, 1994 which discloses a land-based device having two heavy blocks supporting a shield. The two blocks are held in place relative to each other by a connecting strap.

U.S. Pat. No. 4,184,501 issued on Jan. 22, 1980 discloses a solar shield adapted to cover a vehicle directed primarily to a means for securing the shield to the vehicle.

No known devices are adapted to provide protection to an individual while the individual is on the water, for example, while floating on a raft or other floatation device. It may be appreciated that there continues to be a need for an improved sun shield which addresses the problems of ease of use and use on the water.

Accordingly, it is an object of the present invention to substantially overcome the above-described problems.

It is another object of the present invention to provide a novel sun shield to protect an individual from the harmful effects of the sun while the individual is floating on the water.

It is a further object of the present invention to provide a novel sun shield that is fast and easy to assemble and disassemble.

It is also an object of the present invention to provide a novel sun shield that is inexpensive to manufacture and may be fabricated from commercially available parts.

SUMMARY OF THE INVENTION

The disadvantages of known sun shields are substantially overcome with the present invention by providing a novel floating sun shield configured to protect an individual from the harmful effects of the sun while the individual is floating in water on a floatation device.

The harmful effects of the sun are commonly known today. As such, individuals who enjoy exposure to the sun and who continue to sun bathe, frequently limit their exposure and often use topically applied sun blocks. While on land, either at a beach or a pool, sun bathers often seek shade under a chair canopy, umbrella, or other shade providing structure. However, while in the water, the individual is afforded no protection against the sun, other than that which is provided by the topically applied lotion. Since sun bathers often relax while disposed upon rafts or other floatation devices, the danger of falling asleep and receiving a severe sun bum is apparent. The novel floating sun shield is configured to be used by an individual while the individual is in the water, preferably while the individual is floating on a floatation device, such as a raft. The frame of the floating sun shield defines a perimeter of a user area in which the user may place his or her floatation device. While the user is within the user area, an overhead canopy protects the user from exposure to the sun.

More specifically, the floating sun shield apparatus of the present invention includes a frame having oppositely disposed longitudinal frame members and oppositely disposed transverse frame members. The frame members have a perimeter defining a user area within. Also included is a canopy operatively coupled to the frame and disposed over the user area where the canopy is configured to block sunlight from the user area. Two flexible canopy support rods releasably attach to the frame at opposite ends substantially forming an arch where each support rod is configured to attach to either the longitudinal frame members or to the transverse frame members such that the canopy support rods are maintained in a flexed convex orientation relative to the frame. The canopy has opposite longitudinal sides configured to engage the canopy support rods such that the canopy is maintained in a curved orientation above the user area. The frame is configured to be buoyant in water such that the canopy is maintained above the user area

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
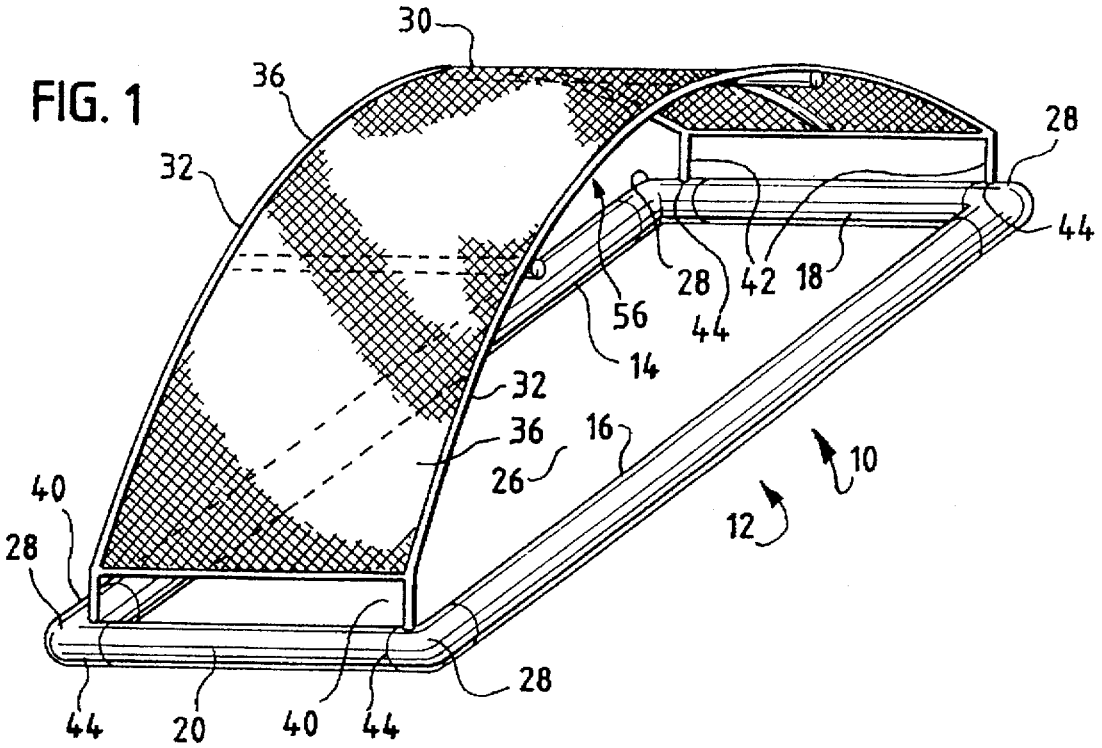
FIG. 1 is a perspective view of a specific embodiment of a floating sun shield, according to the present invention.

Referring now to FIGS. 1–4, a specific embodiment of a floating sun shield 10 is shown. The sun shield includes a frame 12 having oppositely disposed longitudinal frame members 14 and 16, and oppositely disposed transverse frame members 18 and 20. The frame 12 is generally rectangular in shape and its perimeter defines a user area 26 within. Preferably, the frame members 14, 16, 18, and 20 are releasably coupled to each other by connecting joint members 28. The connecting joint members 28 are essentially "elbow joint" members having a flange configured to receive the corresponding frame member 14, 16, 18, or 20, as is known in the art.

The frame members 14, 16, 18, and 20 are preferably hollow and may be formed, for example, from commercially available PVC (polyvinyl chloride) pipe commonly used in the plumbing industry. Such pipe is inexpensive and strong and is available in a variety of lengths and diameters. Additionally, the PVC pipe is easy to cut into appropriate lengths. Alternately, the frame members may be formed from buoyant foam or other floatable material. The connecting joint members, such as the elbow joints 28, are widely available such that a frame of almost any shape and size may be constructed. The frame members 14, 16, 18, and 20 are preferably joined together the elbow joints 28 in a releasable manner so that the frame 12 may be easily disassembled for convenient storage. A friction or pressure fit between the frame members 14, 16, 18, and 20 and the elbow joint 28 preferably retains the members together forming a water-tight seal. The elbow joints 28 and the frame members 14, 16, 18 and 20 may also have threaded ends so that the frame members may be attached by screwing the members into place. Alternately, the frame members 14, 16, 18, and 20 may be permanently fixed to the elbow joints 28 using a suitable chemical adhesive or bonding compound, as is known in the art.

Figure 5:
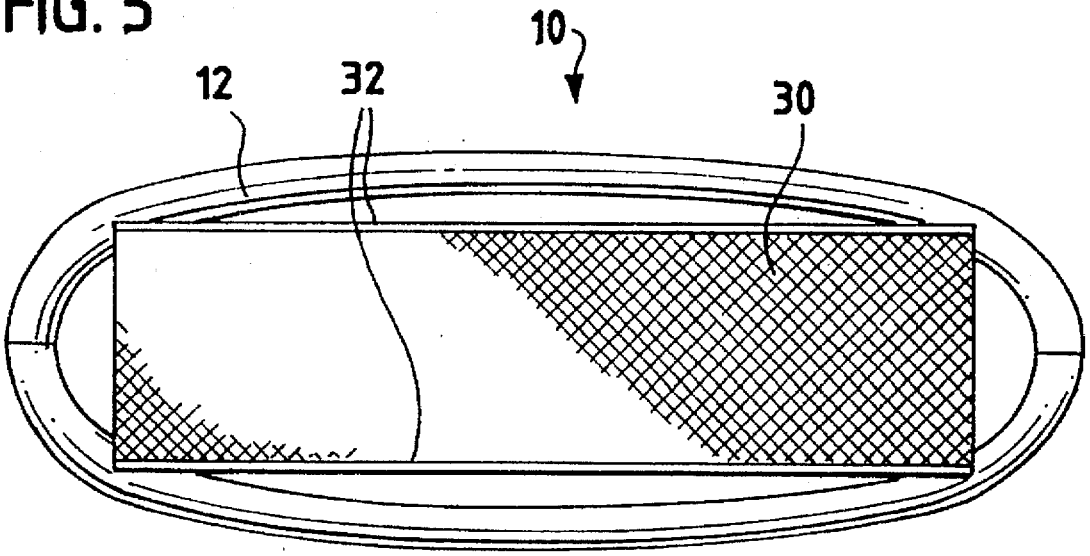
FIG. 5 is a top plan view of an alternate embodiment of a floating sun shield.

Alternately, the frame 12 may be an integrally formed one-piece structure in the form of a continuous circular or rectangular tubular ring. However, any suitable shape may be used, such as an elongated or oblong shape, as is shown in FIG. 5. The frame 12 may be a single integrally formed piece not subject to disassembly, or may be formed from multiple portions. The frame 12 may be formed using known extrusion or injection molding techniques.

In either case, whether the frame members 14, 16, 18, and 20 are releasably joined or are permanently joined, the frame 12 forms a sealed structure so that water cannot enter. Since air is essentially trapped within the frame 12, the frame is buoyant in water and floats. The dimensions of the frame members 14 are such that the amount of air trapped within the frame 12 produces an amount of buoyancy sufficient to permit the frame and other structures attached to the frame, described below, to float on water. In one example of the preferred embodiment, the longitudinal frame members 14 and 16 are eighty-eight inches in length and one and one-half inches in diameter, and the transverse frame members 18 and 20 are forty-one inches in width and one and one-half inches in diameter. The elbow joints 28 are of a similar diameter sufficient to permit joining of the frame members 14, 16, 18, and 20, but may have flanges larger than one and one-half inches to receive the frame members. However, the dimensions may be modified to provide a frame of any suitable dimension.

A canopy 30 is operatively coupled to the frame 12 and is disposed over the user area 26 to provide shade and block sunlight from the user area. The canopy 30 is supported by two flexible canopy support rods 32 releasably attached to the frame 12 at opposite ends to form an arch or dome-like structure, as will be described below in greater detail. The canopy 30 is preferably formed from nylon fabric but may be formed from any suitable material, such as cotton, or any other suitable synthetic material, such as plastic, DACRON®, polyester, GORTEX®, and the like. Additionally, the canopy 30 may be formed from material adapted to pass a predetermined amount of sunlight through the material to provide a sunblock factor, rather than providing a complete block of all sunlight. The canopy 30 may also be formed from a mesh-like material where the size of the mesh or the density the weave provides for partial transmission of sunlight through the material.

The canopy 30 is preferably one hundred and six inches in length and forms an arc when supported by the canopy support rods 32 such that the flat area subtended by the arc is approximately equal to the length of the frame 12. The width of the canopy 30 is about forty inches, but may be modified to be any suitable width less than the width of the frame 12. The canopy 30 preferably has sewn pockets 36 disposed on opposite longitudinal edges that extend along its entire length. The pockets 36 may be formed by folding over and sewing a portion of the longitudinal edge of the canopy 30. The pockets 36 are configured to receive the canopy support rods 32 such that the canopy support rods extend throughout and beyond the length of the canopy 30. Alternately, the canopy 30 may be tied to the support rods 32 using suitable ties or connectors distributed along the length of the canopy. The canopy support rods 32 completely support the canopy 30 in an arc-like configuration above the user area 26.

Each canopy support rod 32 is configured to attach to either the longitudinal frame members 14 and 16 or to the transverse frame members 18 and 20, depending upon the exact placement location. Each canopy support rod 32, when not flexed, is longer than the length of the frame 12 so that the support rods are forced to assume a flexed convex orientation when fixed to the frame. The canopy support rods 32 may also be formed from hollow plastic tubing, such as one-half inch diameter PVC pipe, or may be formed from solid plastic or other flexible tubular stock.

Figure 2:
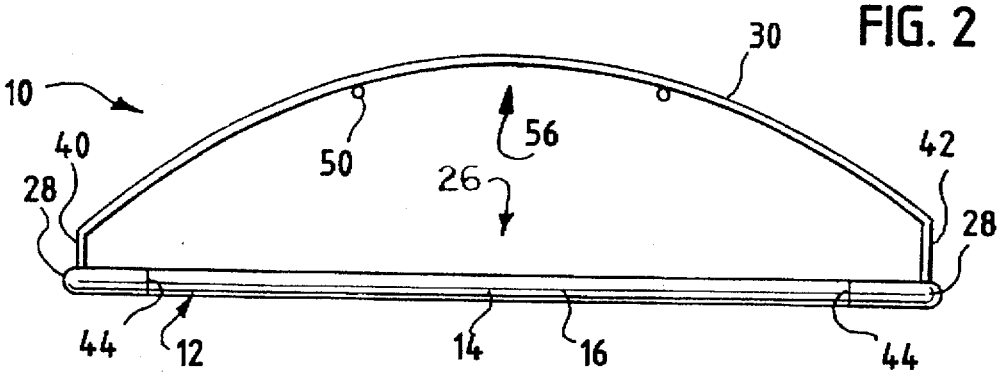
FIG. 2 is a side elevational view of a specific embodiment of the floating sun shield shown in FIG. 1.

As clearly shown in FIGS. 1 and 2, the canopy support rods 32 terminate at opposite ends in first and second vertical portions 40 and 42 that are configured to elevate the arch formed by the canopy support rods above the frame 12 by a predetermined distance. This provides a user headroom area and user foot-room area. This arrangement clearly raises the canopy 30 above the level of the frame 12, for example, by two to six inches. Preferably, the head room is provided by a vertical raise of about five inches, while the foot-room raise is provided by a vertical raise of about two and one-half inches. The head room permits the user to utilize the length of user area 26 more efficiently and permits the user's head to abut the transverse frame members 18 and 20 without contacting the canopy 30. Also, the head room provides an area through which the user may see in an unobstructed manner. Preferably, the vertical portions 40 and 42 are separate sections of either hollow or solid tubing connected to the canopy support rods 32 via a connector section (not shown). Such connector sections are similar to the elbow joints 28 but are not configured with a ninety-degree bend. Rather, the connector section may have a one hundred and thirty-five-degree angle joint. Note that the angle between the canopy support rod 32 and the vertical portions 40 and 42 may be varied and may even vary between opposite ends of the frame 12. This provides a slightly different slope for the canopy 30, depending at which end of the apparatus 10 the user places his or her head. Alternately, the vertical portions 40 and 42 may be integrally formed with the canopy support rods 32 such that an appropriate bend in the canopy support rod at opposite ends forms the vertical portions. In another embodiment, no vertical portions are included and the canopy support rods 32 complete their natural arc and attach to the frame. In this case, the canopy 30 may have a reduced length so that the canopy material is not adjacent the frame.

Whether the vertical portions 40 and 42 are separate from or integral with the canopy support rods 32, the end of the structure is releasably attached to the frame 12. For purposes of illustration only, as described hereinafter, the vertical ends 40 and 42 of the canopy support rod 32 will be said to releasably attach to the frame 12, although either the vertical portions 40 and 42 or the end of the canopy support rod may be attached to the frame. Preferably, each transverse frame member 16 and 18 includes a sealed recess or boss 44 (FIGS. 1 and 2) configured to receive a portion of the vertical portion 40 and 42 to maintain the canopy support rod 32 in the flexed convex orientation. The sealed boss 44 may provide a friction fit or a snap-fit, as is known in the art. The sealed boss 44 is configured to permit the user to quickly and easily bend the canopy support rod 32 and insert the vertical portion 40 or 42 into the boss. The bosses 44 are sealed to prevent water from entering the frame 12 to maintain a sealed structure. The bosses 44 may be integrally formed with the frame 12 or may be inserted into the transverse frame members 16 and 18 using a socket-like arrangement. Note that the canopy support rods 32 do not necessarily attach to the transverse frame members 16 and 18 and may alternately attach to the longitudinal frame members 14 and 16, or to the elbow joints 28.

Alternately, an attachment device (not shown), not integrally formed with the frame, may hold the canopy support rods 32 adjacent the frame 12. Such an arrangement, for example, may be a clip and tie arrangement where a tie is secured around the frame member and includes an attached clip configured to secure the canopy support rods 32. Also, a pocket or hard curved shell (not shown) may be fastened to the frame members 14, 16 and 20 with a suitable chemical adhesive to provide a recess configured to receive the canopy support rod 32.

Figure 3:
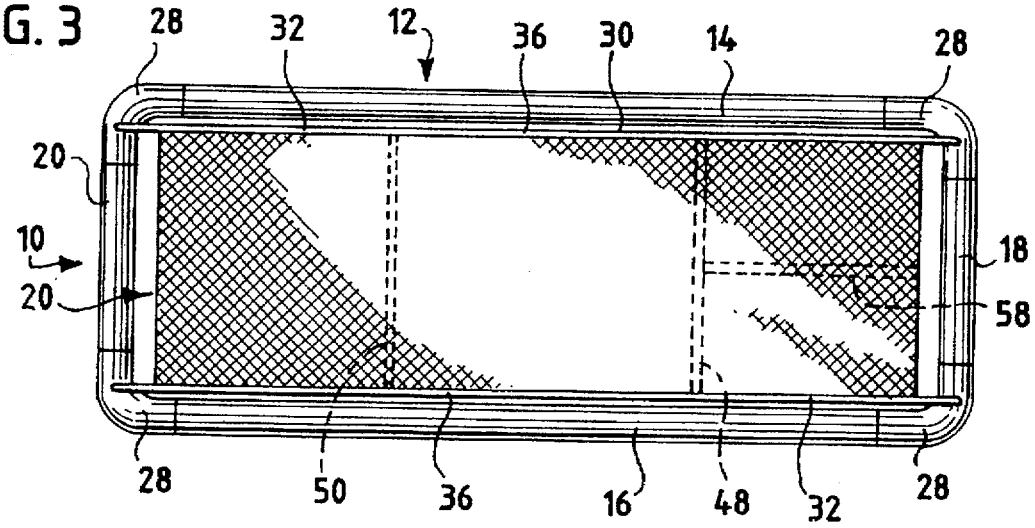
FIG. 3 is a top plan view of a specific embodiment of the floating sun shield shown in FIG. 1.
Figure 4:
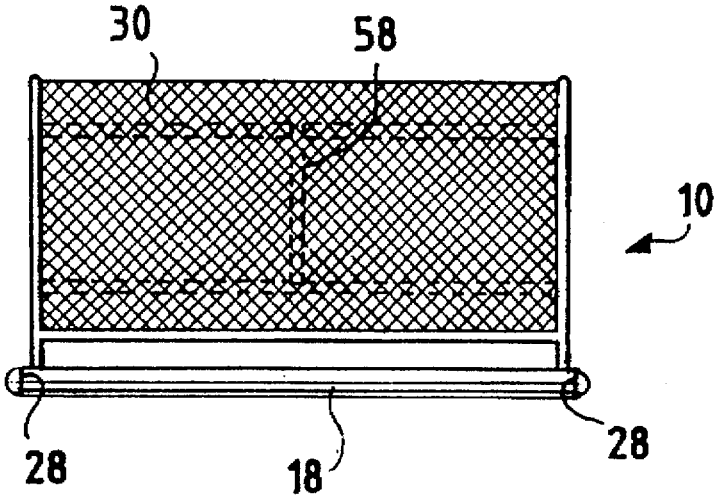
FIG. 4 is a front head-on view of a specific embodiment of the floating sun shield shown in FIG. 1.

Referring now to FIGS. 1–3, the canopy 30 includes a spacer bar 48 disposed between the canopy support rods 32, which spans the width between the support rods. The spacer bar 48 is configured to maintain the canopy support rods 32 in a spaced apart relationship such that the canopy 30 is maintained in a substantially spread apart manner without sagging in the middle. Alternately, a second spacer bar 50 may be included depending upon the type of fabric used to construct the canopy 30. The spacer bars 48 and 50 may be attached to the canopy support rods 32 via gaps in the canopy pockets 36 that expose the canopy support rods. The spacer bars 48 and 50 may have a forked end configured to engage the diameter of the canopy support rod 32 and may be held in place against the compressive tension provided by the canopy material. Alternately, the canopy support rods 32 may be provided with a "T-fitting" which receives the spacer bars 48 and 50. Any suitable connection arrangement may be used, as is known in the art. Preferably, the spacer bars 48 and 50 are disposed adjacent an inside surface 56 (FIGS. 1 and 2) of the canopy 30 and midway along a width of the canopy to further prevent sagging of the canopy material.

Alternately, an additional canopy lifting member 58 (FIGS. 3 and 4) may be disposed adjacent the inside surface 56 of the canopy 30 at right angles to either of the spacer bars 48 and 50. Preferably, the canopy lifting member 58 is parallel to the longitudinal frame members 14 and 16 and is disposed midway along the width of the canopy 30. The canopy lifting member 58 is configured to reduce or eliminate sagging of the canopy directly above the head of the user. Alternately, the canopy lifting member 58 may be in the form of one or two diagonal braces (not shown) extending along a portion of the length of the canopy 30 and disposed between opposite canopy support rods 32 in a diagonal fashion.

Specific embodiments of a floating sun shield according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A floating sun shield apparatus comprising:

a frame having a longitudinal axis and a transverse axis, at least a portion of the frame formed from rigid hollow members;

the frame having a perimeter defining a throughway providing an unobstructed open area within the perimeter to create a user area within;

a canopy operatively coupled to the frame and disposed over the user area, the canopy configured to substantially block sunlight from the user area;

canopy support rods releasably attached to the frame at opposite ends of the frame, the support rods configured to support the canopy over the user area;

the canopy having sides configured to engage the canopy support rods; and the frame configured to be buoyant in water such that the frame maintains the canopy over the user area when the frame is placed in water.

2. The apparatus according to claim 1 wherein the frame further comprises at least two releasably attachable frame portions configured to form a sealed structure that is buoyant in the water.

3. The apparatus according to claim 1 wherein the frame includes sealed bosses configured to receive a portion of the canopy support rod to maintain the support rod in a flexed convex orientation.

4. The apparatus according to claim 1 wherein each canopy support rod has first and second opposite ends terminating in corresponding first and second vertical portions, the vertical portions configured to elevate the canopy support rods above the frame by a predetermined distance to provide a user head-room area.

5. The apparatus according to claim 1 wherein the canopy is formed from at least one of a fabric material and a plastic material.

6. The apparatus according to claim 5 wherein the fabric material is nylon fabric.

7. The apparatus according to claim 1 wherein the canopy is formed from material configured to block a predetermined portion of sunlight.

8. The apparatus according to claim 1 wherein the frame is formed from at least one of hollow tubing and floatable foam.

9. The apparatus according to claim 1 further including a spacer bar disposed between the canopy support rods and transverse thereto, the spacer bar configured to maintain the canopy support rods in a spaced apart relationship such that the canopy is maintained in a substantially spread apart manner.

10. A floating sun shield apparatus comprising:

a frame having oppositely disposed longitudinal frame members and oppositely disposed transverse frame members, at least a portion of the frame members formed from rigid hollow members;

the frame having a perimeter defining a throughway providing an unobstructed open area within the perimeter defining a user area within;

a canopy operatively coupled to the frame and disposed over the user area, the canopy configured to block sunlight from the user area;

two flexible canopy support rods releasably attached to the frame at opposite ends substantially forming an arch, each support rod configured to attach to at least one of the longitudinal and transverse frame members such that the canopy support rods are maintained in a flexed convex orientation relative to the frame;

the canopy having opposite longitudinal sides configured to engage the canopy support rods such that the canopy is maintained in a curved orientation above the user area; and the frame configured to be buoyant in water such that the canopy is maintained above the user area.

11. The apparatus according to claim 10 wherein at least one of the longitudinal frame members and the transverse frame members include a sealed boss configured to receive a portion of the canopy support rod to maintain the support rod in the flexed convex orientation relative to the frame.

12. The apparatus according to claim 10 wherein each canopy support rod has first and second opposite ends terminating in corresponding first and second vertical portions, the vertical portions configured to elevate the arch formed by the canopy support rods above the frame by a predetermined distance to provide a user headroom area.

13. The apparatus according to claim 12 wherein each end of the first and second ends of the canopy support rod meet the corresponding first and second vertical portions at a predetermined angle.

14. The apparatus according to claim 10 wherein the canopy is formed from at least one of a fabric material and a plastic material.

15. The apparatus according to claim 14 wherein the fabric material is nylon fabric.

16. The apparatus according to claim 14 wherein at least one of the longitudinal and transverse frame members are formed from hollow tubing, the frame members forming a sealed structure so as not to admit water within the frame such that the frame remains buoyant in water to maintain the canopy at a predetermined height above the user area.

17. The apparatus according to claim 10 wherein the canopy is formed from material configured to block a predetermined portion of sunlight.

18. The apparatus according to claim 10 wherein at least one of the longitudinal and transverse frame members is formed from at least one of hollow plastic tubing and floatable foam.

19. The apparatus according to claim 10 further including a spacer bar disposed between the canopy support rods and transverse thereto, the spacer bar configured to maintain the canopy support rods in a spaced apart relationship such that the canopy is maintained in a substantially spread apart manner.

20. The apparatus according to claim 19 further including a canopy lifting member disposed adjacent to an inside surface of the canopy and midway along a width of the canopy, the canopy lifting member disposed between a transverse frame member and the spacer bar and configured to eliminate sagging of the canopy.

21. The apparatus according to claim 10 further including a canopy lifting member disposed adjacent to an inside surf;ace of the canopy and extending along a portion of a length of the canopy, the canopy lifting member disposed between opposite canopy support rods in a diagonal fashion and configured to eliminate sagging of the canopy.

* * * * *